US010618076B2

(12) United States Patent
Pope et al.

(10) Patent No.: US 10,618,076 B2
(45) Date of Patent: Apr. 14, 2020

(54) CONDIMENT DISPENSING DEVICE

(71) Applicant: Huhtamaki, Inc., De Soto, KS (US)

(72) Inventors: Stephen M. Pope, Lenexa, KS (US); Scott L. Wayland, Merriam, KS (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 16/238,393

(22) Filed: Jan. 2, 2019

(65) Prior Publication Data

US 2019/0210059 A1 Jul. 11, 2019

Related U.S. Application Data

(60) Provisional application No. 62/615,568, filed on Jan. 10, 2018.

(51) Int. Cl.

| | |
|---|---|
| ***B05C 17/01*** | (2006.01) |
| ***B67D 1/10*** | (2006.01) |
| ***A47G 19/18*** | (2006.01) |
| ***B05B 15/62*** | (2018.01) |
| ***B05C 17/015*** | (2006.01) |
| ***B05C 17/005*** | (2006.01) |

(52) U.S. Cl.

CPC ..... *B05C 17/0126* (2013.01); *A47G 19/183* (2013.01); *B05B 15/62* (2018.02); *B67D 1/102* (2013.01); *B05C 17/00516* (2013.01); *B05C 17/00596* (2013.01); *B05C 17/015* (2013.01); *B05C 17/0123* (2013.01)

(58) Field of Classification Search

CPC ..... B05C 17/0126; B05C 17/00516; B05C 17/015; B67D 1/102; B04C 17/0116; B04C 17/012; B04C 17/0123

USPC ..... 222/327

See application file for complete search history.

(56) References Cited

U.S. PATENT DOCUMENTS

| | | | | |
|---|---|---|---|---|
| 2,138,045 | A * | 11/1938 | Seeberger | B05C 17/0126 74/148 |
| 3,884,396 | A | 5/1975 | Gordon et al. | |
| 4,269,330 | A | 5/1981 | Johnson | |
| 4,373,646 | A | 2/1983 | MacEwen | |
| 4,396,177 | A | 8/1983 | Liebl | |
| 4,432,473 | A | 2/1984 | MacEwen | |
| 4,830,231 | A | 5/1989 | Smith | |

(Continued)

FOREIGN PATENT DOCUMENTS

| | | |
|---|---|---|
| CN | ZL 03804798.5 | 5/2007 |
| WO | 03059784 A1 | 7/2003 |
| WO | 2017210859 A1 | 12/2017 |

*Primary Examiner* — Benjamin R Shaw

(74) *Attorney, Agent, or Firm* — Husch Blackwell LLP

(57) ABSTRACT

A condiment dispensing device is provided that, when activated by a user, may expel a condiment from a condiment cartridge secured within the condiment dispensing device. The condiment dispensing device includes a recess at its bottom portion in which a dampener member may be secured. When the dampener member is secured in the recess, the bottom portion of the dispensing device is flat, which results in the device being orientation within a holder in a consistent and predictable fashion. Because the dampener member may be made of a rubber or soft plastic, when the condiment dispensing device is placed in the holder, substantially less impact and noise are created than if the dispensing device were construed entirely made of metal.

16 Claims, 7 Drawing Sheets

(56) References Cited

U.S. PATENT DOCUMENTS

| | | | | |
|---|---|---|---|---|
| 6,096,412 | A * | 8/2000 | McFarland | A61F 13/15203 428/211.1 |
| 6,371,335 | B1 | 4/2002 | MacEwen | |
| 6,585,696 | B2 * | 7/2003 | Petersen | A61B 17/00491 222/391 |
| 6,655,554 | B2 | 12/2003 | Pantelleria et al. | |
| 7,959,038 | B2 | 6/2011 | De Oliveira et al. | |
| 8,146,781 | B2 | 4/2012 | Robertson et al. | |
| 8,561,854 | B2 | 10/2013 | Tirone et al. | |
| 8,650,736 | B2 | 2/2014 | Robertson et al. | |
| 9,333,605 | B2 | 5/2016 | Robertson et al. | |
| 2002/0108971 | A1 * | 8/2002 | Lafond | B05C 17/0103 222/333 |
| 2002/0145014 | A1 * | 10/2002 | Harris | B05C 17/01 222/326 |
| 2005/0116134 | A1 * | 6/2005 | Lee | D06F 37/20 248/650 |
| 2012/0223098 | A1 * | 9/2012 | Natterer | B05B 9/043 222/63 |
| 2012/0318826 | A1 * | 12/2012 | Naughton | B05C 17/01 222/327 |
| 2013/0102446 | A1 | 4/2013 | Robertson et al. | |
| 2013/0153600 | A1 * | 6/2013 | Sanfilippo | B65D 35/30 222/95 |
| 2014/0008397 | A1 | 1/2014 | Edamatsu et al. | |
| 2015/0375905 | A1 | 12/2015 | Caunant | |
| 2018/0038598 | A1 * | 2/2018 | Tonietto | A47B 91/06 |

* cited by examiner

PRIOR
ART

CONDIMENT DISPENSING DEVICE

CROSS-REFERENCE TO RELATED APPLICATIONS

This application claims the benefit of U.S. Provisional Application No. 62/615,568 for a "Condiment Dispensing Device" to Stephen M. Pope et al., filed Jan. 10, 2018, which is hereby incorporated by reference in its entirety.

FIELD OF THE INVENTION

The present invention relates generally to a dispensing system, and more particularly to a dispensing device suitable for use in the food industry for applying pre-measured quantities of condiments, and the like, to food products.

BACKGROUND

In the food service industry, uniformly applying condiments such as ketchup, mustard, mayonnaise, sour cream, guacamole, tartar sauce, cream cheese, hot sauce, sandwich spreads, and the like to various dishes such as hamburgers, sandwiches, hotdogs, tacos, and the like can be problematic. Often, these condiments are applied to various foods by an operator using a plastic squeeze bottle. This method can cause a lack of uniformity in the application of the condiment onto the food due to factors such as the amount of condiment in the squeeze container, the hand strength of the operator, and the experience and attentiveness of the operator. The lack of uniformity is particularly undesirable in the franchise and quick service restaurant industry because customers end up with an inconsistent amount of condiments on dishes they have come to know well and expect a consistent amount of condiment thereon. Moreover, the constant repetition of squeezing a squeeze bottle can cause fatigue in an operator and even slow down the food preparation process, which is extremely undesirable in the quick service restaurant industry.

The above shortcomings have caused a desire in the food service industry to dispense pre-measured amounts of various condiments on foods in a quick and accurate manner. As such, several devices have been created for use in the food service industry, including a mechanical pump-type device that operates substantially similar to a caulking gun. These condiment dispensing guns allow an operator, upon pulling a trigger, to cause a ratcheting or otherwise forced plunger to become incrementally displaced. The displacement of the plunger results in a decrease in volume and an increase in pressure within a cartridge holding the condiment to be dispensed, thus causing a pre-measured amount of the condiment to be ejected from one or more openings or slits defined in the end of the cartridge and applied to the food. Like caulking guns, the barrel of existing condiment dispensing guns is often cylindrical in shape and constructed of metal.

Upon the operator completing the task of applying condiment to the food, the operator often slides, tosses, or throws the condiment dispensing gun into a rack, bin or holder for storage along with other condiment dispensing guns when not in use. Because both the condiment dispensing gun and the holder are constructed of metal, the shock created by the impact that occurs when a condiment dispensing gun is tossed into the holder can result in an undesired release of the condiment from the cartridge. Not only does this unintentionally ejected condiment result in waste, but it also creates a mess in the holder that must be cleaned. Once in the holder, known condiment dispensing guns, which are substantially cylindrical in shape, often do not remain in a consistent position, nor are they capable of self-orienting into a repeatable and desired orientation. This can lead to difficulty when an operator attempts to quickly grab a condiment dispensing gun from the holder and can further result in the handles of two adjacently-placed condiment dispensing guns interfering with one another. Moreover, because known condiment dispensing guns and holders are constructed of metal, the act of tossing (or even placing) the dispensing gun in the holder can make an irritating, distracting noise in an already hectic kitchen environment.

Accordingly, a need exists for an improved condiment dispensing device that can be placed within a holder with a reduced amount of impact. A need also exists for a condiment dispensing device that becomes positioned within the holder in a desired and consistent orientation. A further need exists for a condiment dispensing device that may be placed within the holder in a generally quiet manner.

SUMMARY OF THE INVENTION

The condiment dispensing device hereof operates in many ways like those that have been long used in the art. Like known condiment dispensing devices, in the claimed invention, a body is preferably provided for holding a condiment cartridge therein. A ratcheting plunger or other known expulsion member is also preferably provided that allows an operator, when he or she activates the expulsion member (for example by activating a trigger), to expel a condiment from the condiment cartridge.

However, unlike the condiment dispensing guns of the prior art, the claimed condiment dispensing device includes various features that result in the condiment dispensing device being placed more consistently in a desired position and orientation within a holder when not in use. The dispensing device hereof further includes features that help to reduce the impact created and noise made when the dispensing device is placed into its holder when not in use.

A bottom portion of the body that holds the condiment cartridge therein may include a flat surface. Because the surface is flat rather than cylindrical, when the condiment dispensing device is placed in a holder, the flat surface preferably abuts a flat wall of the holder. This preferably allows the condiment dispensing device to be quickly and consistently placed in the same location within the holder when not in use.

At the bottom portion of the body, a recess may be provided in which a dampener member may be secured. The dampener may abut the side wall of the holder when the condiment device dispenser is stored in the holder when not in use. The dampener is preferably made of a material such as a rubber or soft plastic material so that the dampener is more likely to remain abutting the wall when it has been placed in the holder. Also, by making the dampener from a material like rubber or a soft plastic, when the device is placed in the holder when not in use, momentum of the device is slowed so that less impact and noise are created than when the metal-on-metal contact is made, as was done in the prior art embodiments.

At a proximal end of the dampener, closer to the handle of the device that activates the expulsion member, a bumper member can be provided. The bumper member, which may be integrally formed as part of the dampener, preferably projects downwardly from the dampener, away from the condiment cartridge. The bumper member preferably extends outwardly from the dampener sufficiently such that when the condiment dispensing device is placed in a holder, it hangs over an upper edge of the holder to retain the dispensing device within the holder.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DESCRIPTION OF THE PREFERRED EMBODIMENT

Figure 1:
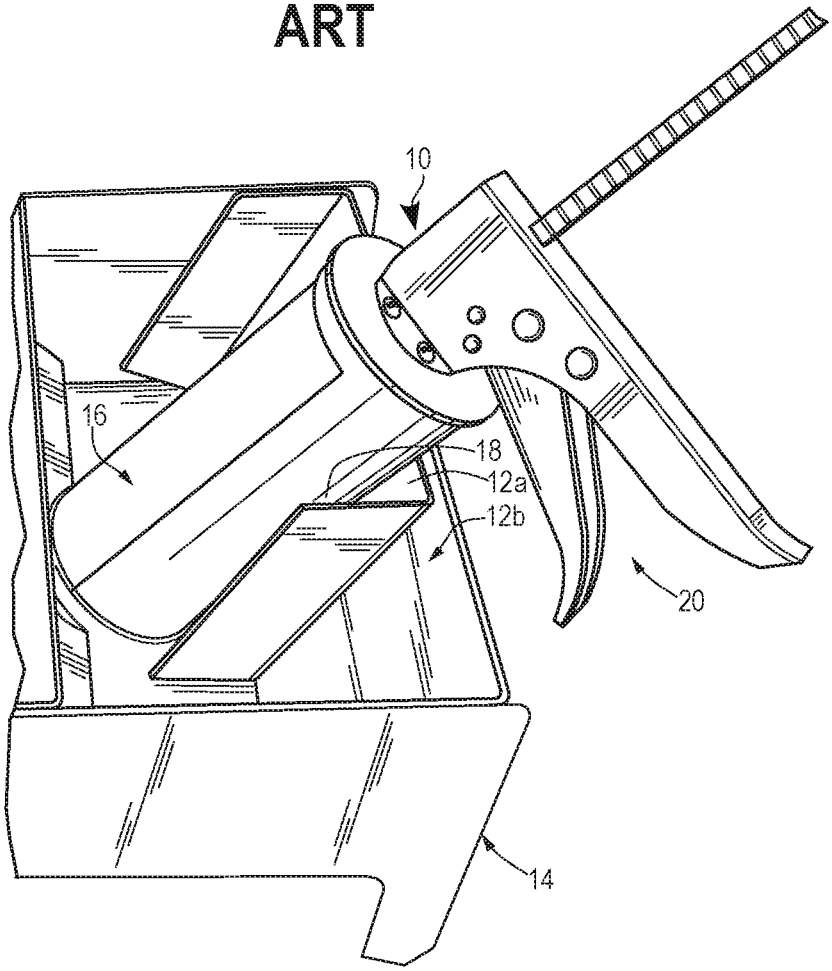
FIG. 1 is a partial perspective view of a condiment dispensing device in accordance with the prior art, illustrating the condiment dispensing device located in a holder in a rotated orientation.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be appreciated that any dimensions included in the drawing figures are simply provided as examples and dimensions other than those provided therein are also within the scope of the invention.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 illustrates an existing condiment dispensing device 10 located within a slot 12*a* of an existing holder 14. As described above, existing condiment dispensing devices 10 are constructed of metal, as are the holders 14. As further described above, existing condiment dispensing devices 10 have a cylindrically-shaped body member 16 having a rounded bottom portion 18. As demonstrated in FIG. 1, the condiment dispensing device 10 is located in the holder 14 in a rotated orientation, as often happens, such that its handle 20 may interfere with a second condiment dispensing device (not shown) in an adjacent slot 12*b* of the holder 14.

Figure 2:
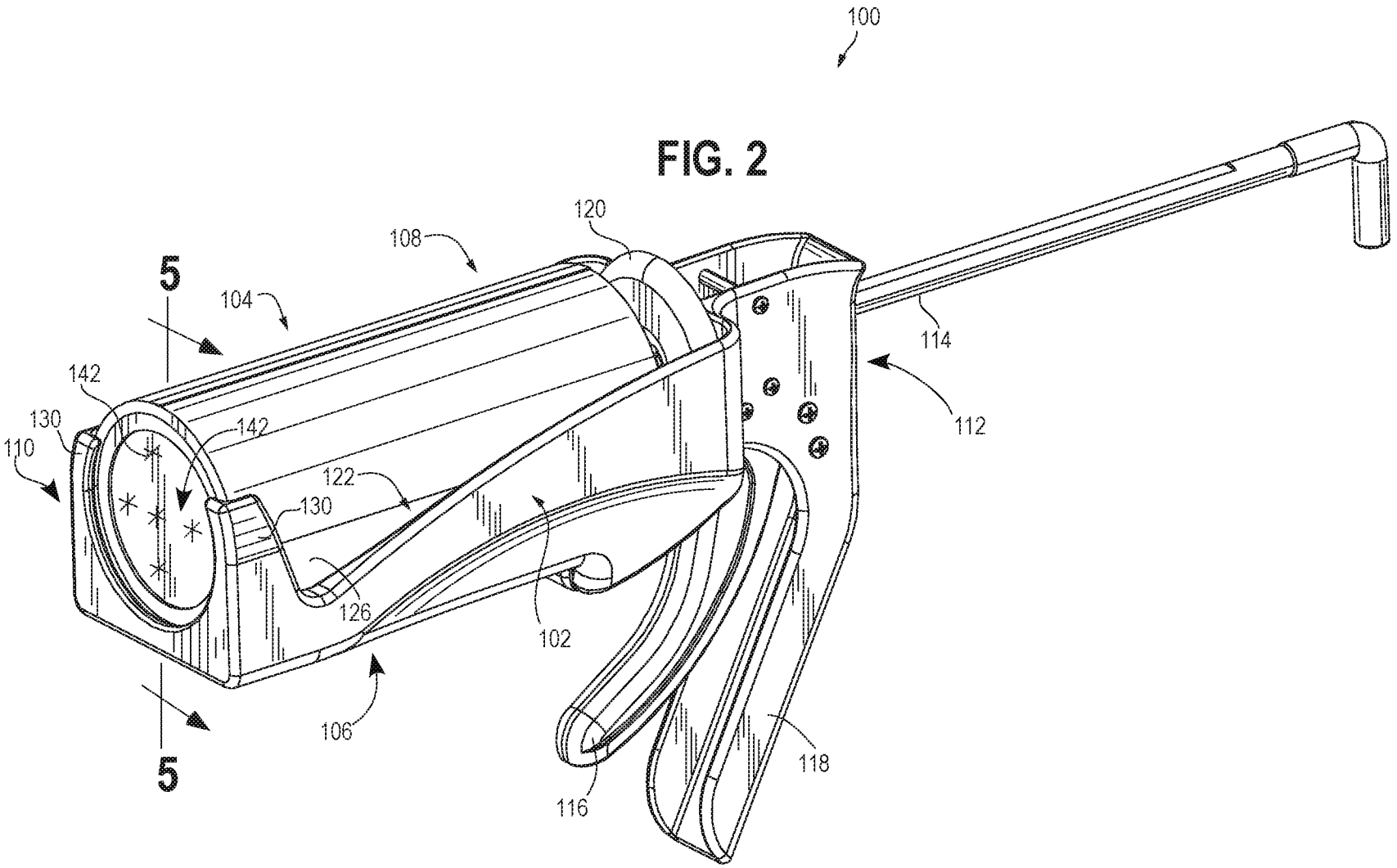
FIG. 2 is a perspective view of a condiment dispensing device having a cartridge placed therein in accordance with one embodiment of the present invention.

Turning to FIG. 2, a condiment dispensing device 100 is provided that, when activated, preferably dispenses a pre-measured quantity of a condiment (e.g., ketchup, mustard, mayonnaise, etc.) on a food product. The condiment dispensing device 100 preferably includes a body member 102 that functions as a housing for securing a container or cartridge 104 therein. While illustrated as being configured for use with a tubular cartridge 104, it will be appreciated that embodiments of the device 100 may be adapted for use with other types of packaging, including flexible packaging, bags, pouches, liners, and the like. The body member 102 can be primarily made of a plastic or other suitable polymer material (with the exception of the dampener member discussed in greater detail below). The cartridge 104 is preferably cylindrical and may be, for example, a Quikspread® container manufactured and sold by Huhtamaki. At a bottom portion 106 of the body member 102, an interior (not illustrated) of the body member is also preferably cylindrical so that the cartridge 104 may be cradled and securely contained within the body member 102 via a friction fit, although other fastening means and methods are also envisioned herein.

In the illustrated embodiment, an upper portion 108 of the body member 102 is open so that the cartridge 104 may be switched out for another cartridge when the cartridge 104 is depleted or another cartridge having a different condiment is desired by an operator. A distal portion 110 of the dispensing device 100 is also preferably generally open so that condiments dispensed from the cartridge 104 may be ejected though openings or slits 142 without obstruction onto a food product when the dispensing device 100 is activated in the manner described below. As will be recognized and appreciated by a person having ordinary skill in the art, the distal portion 110 of the dispensing device 100 is away from the operator when the device 100 is used to dispense a condiment.

A proximal portion 112 of the dispensing device 100 is near an operator when the dispensing device 100 is utilized to dispense a condiment. At the proximal portion 112 of the dispensing device 100 a rod or expulsion member 114 is preferably provided that may engage with the cartridge 104 and/or the contents within the cartridge 104, and serve as the mechanism to activate the dispensing of a condiment. In FIG. 2, the expulsion member 114 is provided as part of a ratchet system in communication with a plunger 120. When a trigger member 116 adjacent a handle member 118 is activated, the expulsion member 114 operates in a known manner to initiate expulsion of a condiment in a pre-measured quantity.

More particularly, when an operator activates the trigger member 116 by pulling it towards the handle member 118, the expulsion member 114 causes the plunger 120 to travel toward the distal portion 110 of the body member 102. The mechanism by which this occurs could be any known mechanism known or understood in the art, including a ratcheting system, air piston, pneumatic system, hydraulic system, electric motor, or the like. Every time the trigger member 116 is activated, the plunger 120 may travel toward the distal portion 110 incrementally. With each incremental movement of the plunger 120 toward the distal portion 110, a pressure is applied within the cartridge 104, thus causing a pre-measured amount of condiment (commensurate with the stroke length of the plunger 120) to be ejected through a one or more openings or slits 142 in the cartridge 104. With each pull of the trigger member 116, the same mechanism may be activated, and approximately the same amount of condiment is preferably dispensed until the cartridge 104 is empty or nearly empty.

Figure 3:
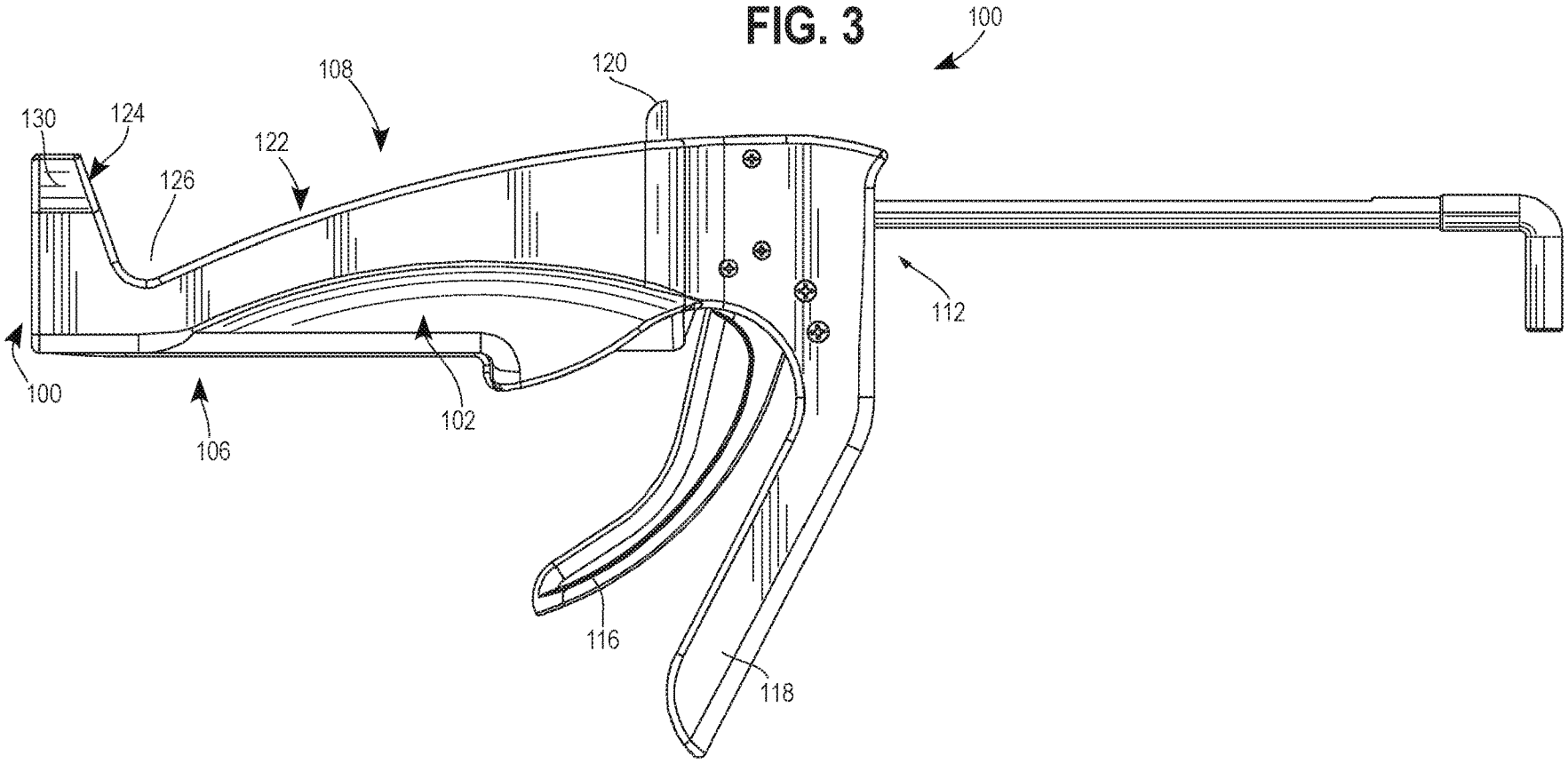
FIG. 3 is side elevation view of the condiment dispensing device of FIG. 2 with the cartridge removed in accordance with one embodiment of the present invention.
Figure 4:
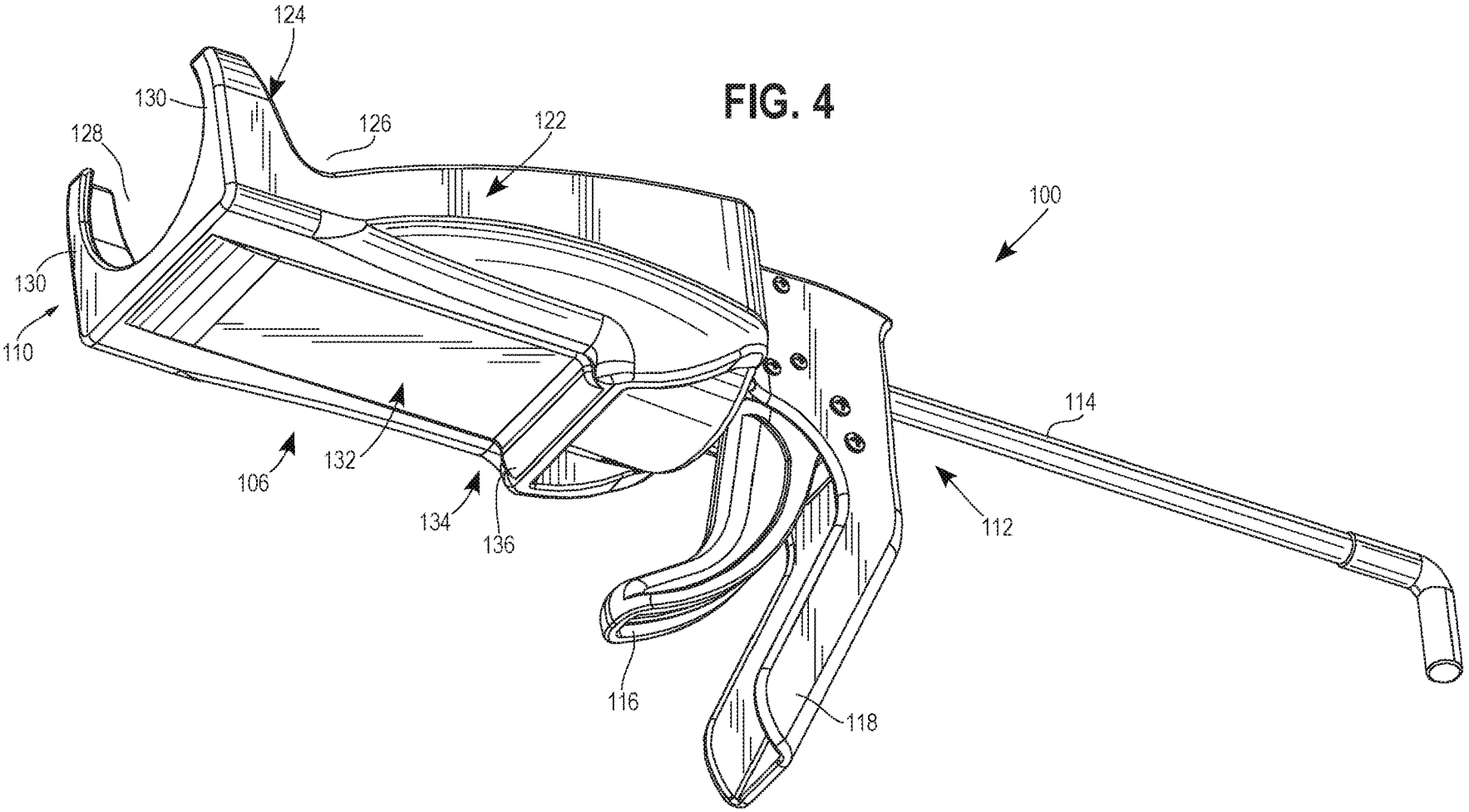
FIG. 4 is a bottom perspective view of the condiment dispensing device of FIG. 2.

Turning now to FIGS. 3 and 4, the shape of the body member 102 is shown in greater detail, with the cartridge 104 removed from the illustrations to better show the body member 102 and its shape. As shown, at the upper portion 108 of the body member 102, a first contour 122 may slope gradually and downwardly along the upper portion 108 of the body member 102 from the proximal portion 112 toward the distal portion 110. The first contour 122 may be curved in nature, but in alternative embodiments may be a straight (or straighter) line.

The upper portion 108 of the body member 102 also preferably includes a second contour 124 which projects upwardly and increases in slope as it approaches the distal portion 110 of the body member 102. In the illustrated embodiment, a valley 126 is provided between the first contour 122 and the second contour 124. The contours 122, 124 may take on a nearly limitless number of slopes, and the valley 126 may be located anywhere along the upper portion 108 of the body member 102. It should be noted that only one side of the condiment dispensing device 100 is shown in FIGS. 3 and 4, but both sides of the dispensing device 100 may include the contours 122, 124 and the valley 126.

In alternative embodiments, the first contour 122 and the second contour 124 may not even exist (nor the valley 126). The contours 122, 124 and resulting valleys 126 may help in grasping the cartridge 104 to remove it from within the body member 102, but the contours 122, 124 are not necessarily crucial to the function of the dispensing device 100 and may be of any suitable shape, size and orientation.

Turning now to FIG. 4, the distal portion 110 of the body member 102 is shown in greater detail. As shown in FIG. 4, the distal portion 110 of the body member 102 is provided with a generally circular, partial cutout 128 that is removed from the distal portion 110, defined by arm members 130 that extend upwardly from the bottom portion 106. The arm members 130 may help to secure the cartridge 104 within the body member 102 by preventing the cartridge 104 from sliding out of the distal portion 15 of the body member 102 when the dispensing device 100 is in use.

The cutout 128 may be smaller or larger in some embodiments, and in other embodiments, it may not be principally circular in shape. In the illustrated embodiment, the distal portion 110 of the body member 102 is open at its upper portion 108. In alternative embodiments, a reinforcing member which connects the arm members 130 to one another may be present to help secure the cartridge 104 within the body member 102.

While having the upper portion 108 of the distal portion 110 of the body member 102 open may help to remove a cartridge 104 from the body member 102, it is not necessarily crucial to the function of the condiment dispensing device 100. In fact, the distal portion 110 of the body member 102 may take a nearly limitless number of configurations (so long as it is generally open such that a condiment may be applied onto a food product).

Figure 5:
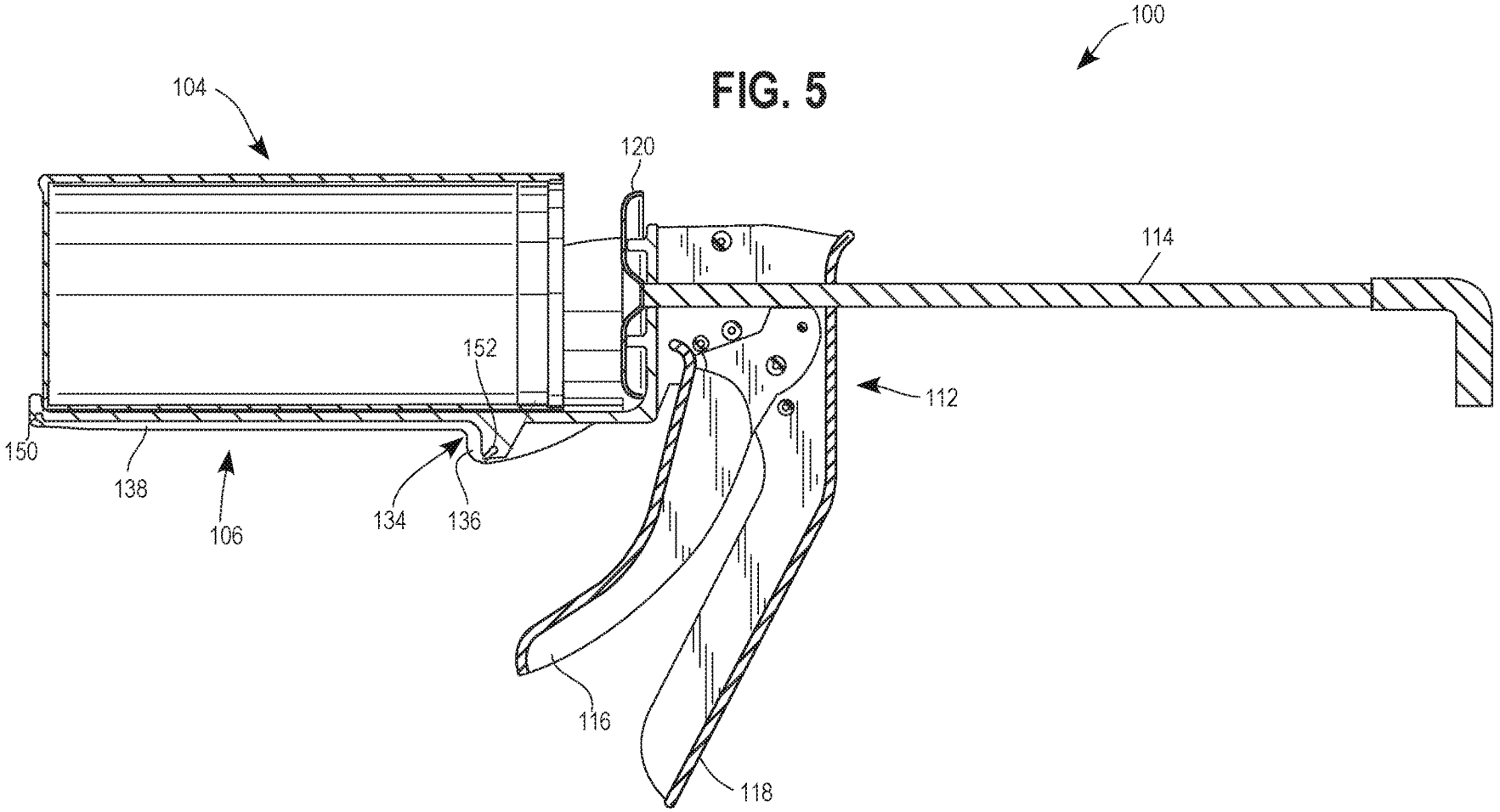
FIG. 5 is a section view taken about line 5-5 of the condiment dispensing device and cartridge of FIG. 2.
Figure 6:
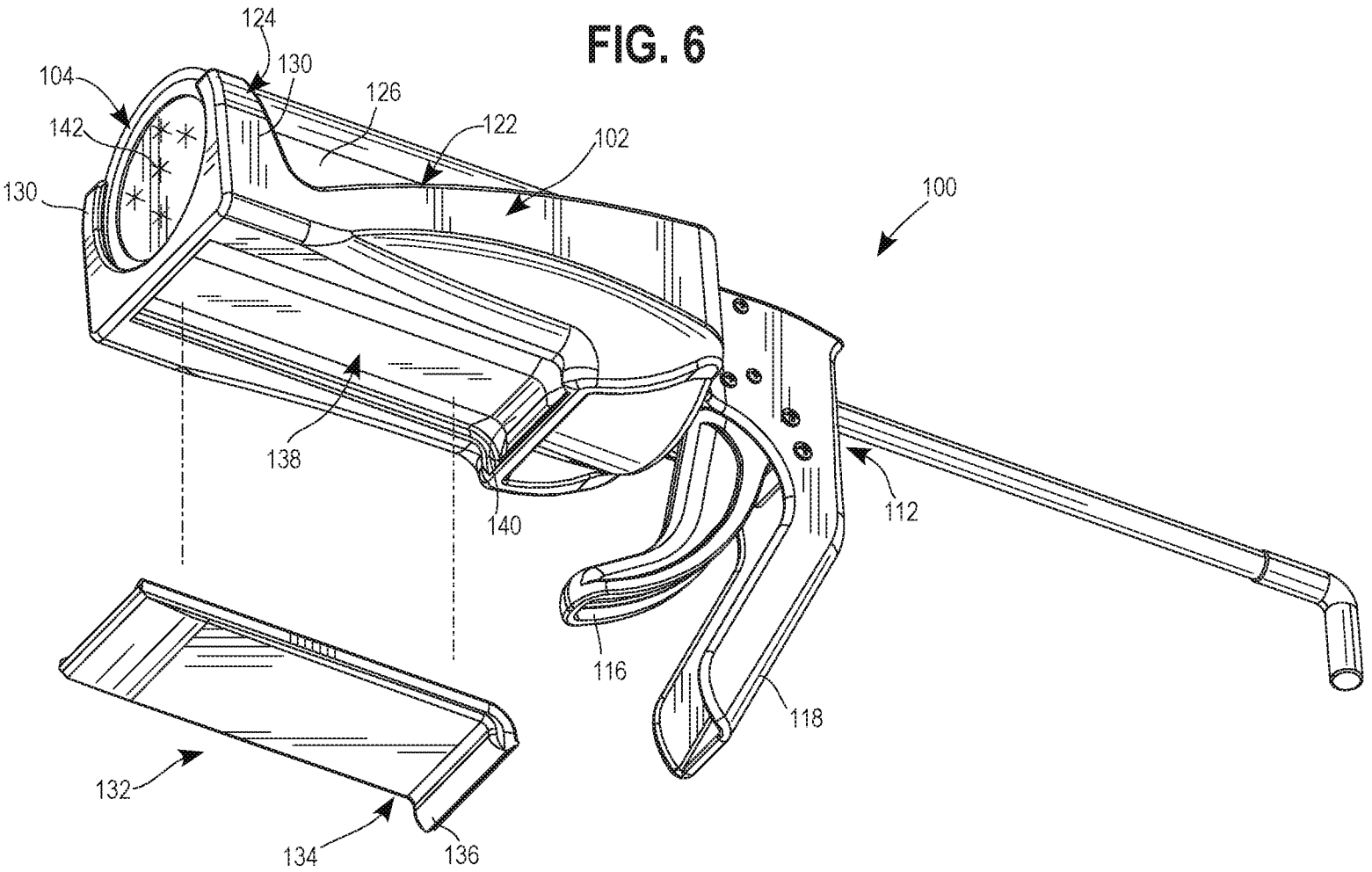
FIG. 6 is a partially exploded bottom perspective view of the condiment dispensing device of FIG. 2.
Figure 7:
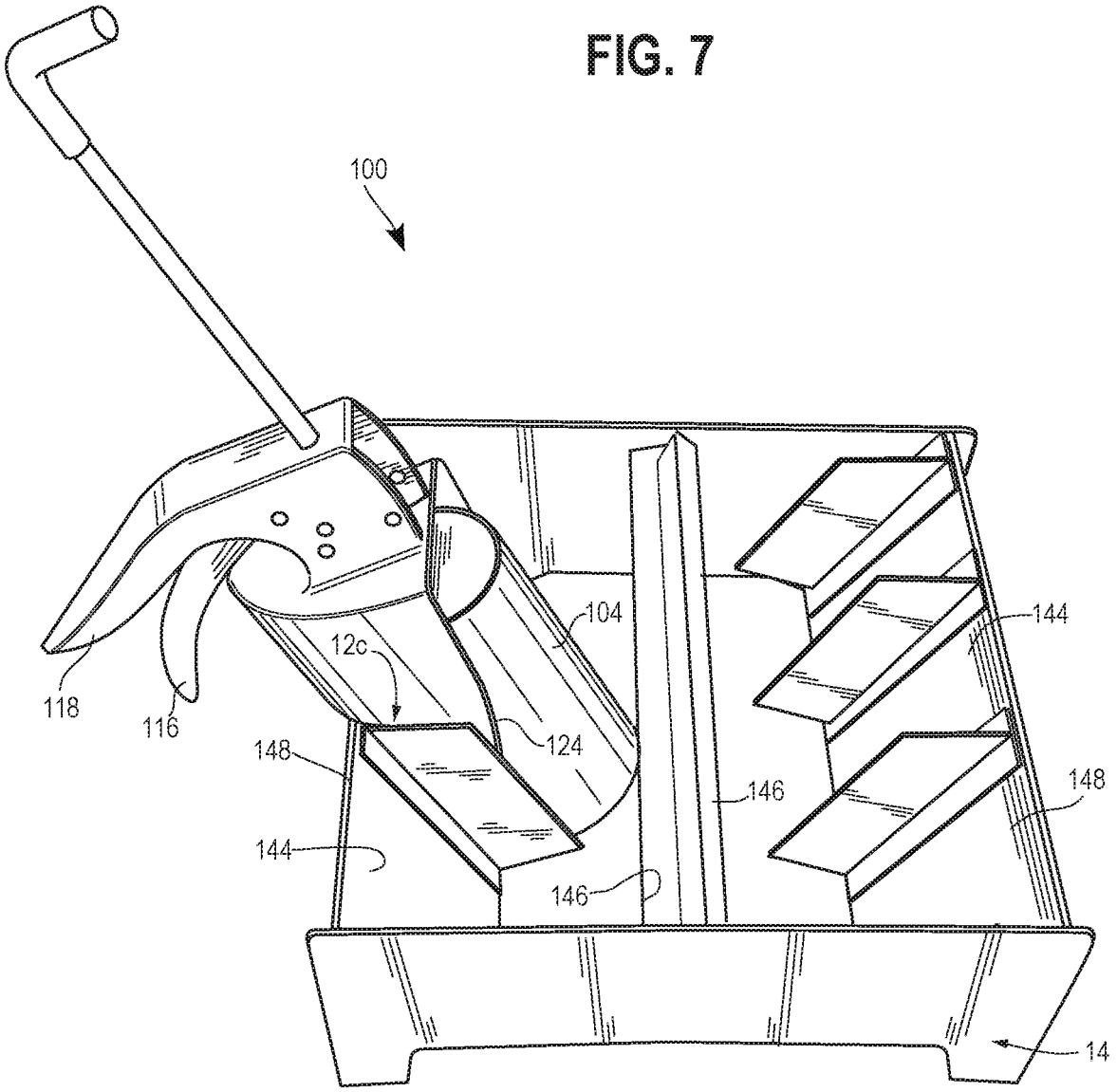
FIG. 7 is a perspective view of the condiment dispensing device of FIG. 2, illustrating the condiment dispensing device located in a holder in accordance with one embodiment of the present invention.

FIGS. 4, 5, and 6 illustrate a dampener member 132 that is preferably located at the bottom portion 106 of the body member 102. The dampener member 132, which is described in greater detail below, may be releasably or permanently secured within or to the bottom portion 106 of the body member 102 such that when the dampener member 132 is secured within the bottom portion 106 of the body member 102, the bottom portion 106 of the body member 102 is substantially flat. Because the bottom portion 106 of the body member (including the dampener member 132 contained therein) is a substantially flat surface, the condiment dispensing device 100 may be placed and perpendicularly oriented within a slot 120 of a holder 14 so that it stays in a desired position, more particularly, a vertical position. In such a position, the bottom portion 106 preferably substantially abuts a side wall 144 (See FIG. 7) of the holder 14 when the dispensing device 100 is stored in the holder 14 and not in use.

In this position, the handle member 118 is preferably easily accessible to an operator such that the handle member 118 may be quickly grabbed by an operator. The flat bottom portion 106 preferably results in a consistent placement of the condiment dispensing device 100 and a consistent orientation of the handle member 118. Such consistent placement of the device 100 and handle member 118 may prevent the device 100 from rotating and interfering with an adjacent device in the holder 14. Such consistent placement in orientation may thus help to keep the condiment application process quick and efficient, an important quality in the food industry, and more particularly, the quick serve restaurant industry. It also may help to prevent condiment from undesired expulsion as well as condiment sticking to the holder 14.

The dampener member 132 is preferably made of a rubber or a soft plastic material. For example, the dampener member 132 may be made of various materials, including but not limited to: silicone, TPE, TPR, EPDM, or neoprene. The dampener member 132 material may have a hardness that is between about 20 and about 90 Shore A in one embodiment, between about 30 and about 80 Shore A in another embodiment, and between about 50 and about 70 Shore A in a further embodiment. Moreover, the dampener member may have an appropriate surface roughness (RA or RMS) to have appropriate non-slip qualities. Materials able to replicate such characteristic are considered herein. In one embodiment, the dampener number 132 may have a texturized bottom surface to reduce slipping. As such, when the condiment dispensing device 100 is placed in a holder 14 so that the bottom portion 106 of the body member 102 abuts a wall 144 of the holder 14, the dampener member 132 preferably has increased friction relative to the wall 144, thus preferably slowing the condiment dispensing device 100 as it is tossed or otherwise placed into slot 12*c* of the holder 14.

Slowing and absorbing the energy from an impact of the condiment dispensing device 100 as it is tossed or placed into the holder 14 preferably reduces the shock on the condiment dispensing device 100 including that resulting from its impact with the wall 144 and lower retaining member 146 of the holder 14. This may reduce and potentially eliminate the undesired expulsion of condiment when the device 100 is tossed into the holder 14. Furthermore, the material of the dampener member 132 preferably reduces the noise that is made when the condiment dispensing device 100, which other than the dampener member 132 is primarily metal, makes when it is dropped into the holder 14.

Near a back end 134 of the dampener member 132, a bumper member 136 may extend substantially perpendicularly downward from the dampener member 132. In one embodiment, the bumper member 136 is integrally formed with the dampener member 132, though in other embodiments, they may be made up of two separate components. Like the dampener member 132, the bumper member 136 is preferably made of either a rubber or a soft plastic material, though other materials are foreseeable that perform the tasks described herein.

When the condiment dispensing device 100 is tossed or placed into a holder 14, the bumper member 136 preferably contacts and engages an upper lip 148 of the holder 14. The bumper member 136 preferably reduces the impact of the condiment dispensing device 100 when it is tossed into the holder 14, also preferably reducing and/or eliminating the undesired expulsion of condiment when the condiment dispensing device 100 is tossed into the holder 14. Moreover, the bumper member 136 may help the dampener member 132 to reduce the amount of noise that is made when the condiment dispensing device 100 is dropped into the holder 14.

Turning now to FIG. 6, a recess 138 may be formed in the bottom portion 106 of the body member 102. The recess 138 is preferably substantially similar in size and shape to the dampener member 132, so that the dampener member 132 may snugly and securely be contained within the recess 138. The recess 138 also preferably includes a bumper recess 140 substantially sized and shaped like the bumper 136 of the dampener member 132 for receiving and securing the bumper 136 therein. When the condiment dispensing device 100 is in use, the dampener member 132 is preferably secured within the recess 138 using known or foreseeable fastening means. In addition to the recesses 138 and 140, the body member 102 may also include grooves or notches 150, 152 (see FIG. 5) into which one or more beads of the dampener member 138 may be received for the further securement. In one embodiment, the dampener member 132 can be glued within the recess 138 using industrial glue, though in other embodiments it may be attached in alternative ways.

From the foregoing, it will be seen that this invention is one well adapted to attain all the ends and objects hereinabove set forth together with other advantages which are inherent to the structure and method. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A dispensing device comprising:

a body member for holding a cartridge therein, the body member having a generally flat bottom portion;

a dampener member secured to the body member;

a recess defined within a bottom portion of the body member for receiving the dampener member therein, the recess including at least one notch for receiving a bead extending from the dampener member; and an expulsion mechanism for engaging with the cartridge so that when the expulsion mechanism is activated, pressure is applied by the expulsion mechanism within the cartridge.

2. The dispensing device of claim 1, wherein the dampener member is secured to the bottom portion of the body member.

3. The dispensing device of claim 2, wherein the dampener member has at least one of a generally flat bottom surface and a generally curved bottom surface.

4. The dispensing device of claim 1, wherein the dampener member is constructed of at least one of rubber, silicone, TPR, TPE, neoprene, and EMPDM.

5. The dispensing device of claim 1, wherein the dampener member is constructed of a material having a hardness of between about 20 and about 90 Shore A.

6. The dispensing device of claim 1, wherein the dampener member is constructed of a material having a hardness less than 90 Shore A.

7. The dispensing device of claim 1, wherein the dampener member includes a bumper member extending downwardly proximate a rear portion of the dampener member.

8. A dispensing device comprising:

a body member for holding a cartridge therein, the body member including a dampener member secured thereto;

the dampener member including a bumper member extending downwardly proximate a rear portion of the dampener member; and an expulsion mechanism in contact with the cartridge so that when the expulsion mechanism is activated, pressure is applied by the expulsion mechanism within the cartridge.

9. The dispensing device of claim 8, wherein the body member includes a generally flat bottom portion.

10. The dispensing device of claim 8, wherein the dampener member is secured to the bottom portion of the body member.

11. The dispensing device of claim 8, wherein the dampener member has a generally flat bottom surface.

12. The dispensing device of claim 8, wherein the dampener member is constructed of at least one of rubber, silicone, TPR, TPE, neoprene, and EMPDM.

13. The dispensing device of claim 8, wherein the dampener member is constructed of a material having a hardness of between about 20 and about 90 Shore A.

14. The dispensing device of claim 8, wherein the dampener member is constructed of a material having a hardness less than 90 Shore A.

15. The dispensing device of claim 8 further comprising a recess defined within a bottom portion of the body member for receiving the dampener member therein.

16. The dispensing device of claim 15, wherein the recess includes at least one notch for receiving a bead extending from the dampener member.

* * * * *